US008348646B2

(12) United States Patent
Fujita et al.

(10) Patent No.: US 8,348,646 B2
(45) Date of Patent: Jan. 8, 2013

(54) VARIABLE DISPLACEMENT VANE PUMP

(75) Inventors: Tomoyuki Fujita, Tokyo (JP); Masamichi Sugihara, Tokyo (JP); Hiroshi Shiozaki, Tokyo (JP); Koichiro Akatsuka, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 917 days.

(21) Appl. No.: 12/385,565

(22) Filed: Apr. 13, 2009

(65) Prior Publication Data

US 2009/0257899 A1 Oct. 15, 2009

(30) Foreign Application Priority Data

Apr. 15, 2008 (JP) ..... 2008-106228

(51) Int. Cl.
*F01C 20/18* (2006.01)
*F04C 14/18* (2006.01)

(52) U.S. Cl. ..... 418/29; 418/30; 418/31; 417/220; 417/310

(58) Field of Classification Search ..... 418/29, 418/30, 31; 417/310, 220
See application file for complete search history.

(56) References Cited

U.S. PATENT DOCUMENTS

| | | | | |
|---|---|---|---|---|
| 4,678,412 | A * | 7/1987 | Dantlgraber | 418/31 |
| 5,538,400 | A * | 7/1996 | Konishi et al. | 418/26 |
| 7,128,542 | B2 * | 10/2006 | Suzuki et al. | 418/30 |
| 8,142,173 | B2 * | 3/2012 | Saga et al. | 418/24 |
| 2001/0031204 | A1 * | 10/2001 | Oba et al. | 418/30 |
| 2009/0269233 | A1 * | 10/2009 | Fujita et al. | 418/26 |

FOREIGN PATENT DOCUMENTS

| | | |
|---|---|---|
| JP | 2002-276564 A | 9/2002 |
| JP | 2007-032517 | 2/2007 |

* cited by examiner

*Primary Examiner* — Mary A Davis
(74) *Attorney, Agent, or Firm* — Rabin & Berdo, P.C.

(57) ABSTRACT

A variable displacement vane pump includes a first and a second fluid pressure chamber (31,32) where the cam ring (4) is made eccentric to the rotor (2) by a pressure difference between the first and the second fluid pressure chamber (31, 32), a control valve (21) for controlling a pressure of the first and the second fluid pressure chamber (31,32) so that an eccentric amount of the cam ring (4) is reduced to be small with an increase in a rotation speed of the rotor (2), a pressure applying section (36) for applying a pressure to the cam ring (4) in a direction of increasing the eccentric amount all the time, and a cam ring movement restricting portion (12) for defining a minimum eccentric amount of the cam ring (4) by restricting the movement of the cam ring (4) in a direction of decreasing the eccentric amount.

3 Claims, 4 Drawing Sheets

VARIABLE DISPLACEMENT VANE PUMP

TECHNICAL FIELD OF THE INVENTION

The present invention relates to a variable displacement vane pump used as a hydraulic supply source in hydraulic equipment.

DESCRIPTION OF RELATED ART

A conventional variable displacement vane pump changes a pump discharge displacement by changing an eccentric amount of a cam ring to a rotor.

JP2007-32517A discloses a variable displacement vane pump which is provided with a first cam chamber and a second cam chamber defined between a cam ring and an adapter ring, a first fluid pressure passage communicated with the first cam chamber and a second fluid pressure passage communicated with the second cam chamber, and a control valve for controlling a pressure in an operating fluid in the first cam chamber through the first fluid pressure passage and a pressure in an operating fluid in the second cam chamber through the second fluid passage, wherein a swing motion of the cam ring caused by a pressure difference between the first cam chamber and the second cam chamber changes a pump discharge displacement.

SUMMARY OF THE INVENTION

In the variable displacement vane pump disclosed in JP2007-32517A, the cam ring is urged in the direction of increasing an eccentric amount of the cam ring to the rotor by a spring and a through hole is formed in a pump body and the adapter ring for accommodating and incorporating respective members such as the spring therein.

Therefore, at a pump manufacturing time, it is necessary to process a hole in the pump body and the adapter ring and also the process of incorporating the respective members such as the spring into the pump body and the adapter ring is required, thus leading to an increase in manufacturing costs.

The present invention is made in view of the foregoing problem and an object of the present invention is to provide a variable displacement vane pump which can reduce manufacturing costs with a simple structure thereof.

In order to achieve above object, the invention provides a variable displacement vane pump having a rotor connected to a drive shaft, a plurality of vanes provided in the rotor so as to be capable of reciprocating in a diameter direction of the rotor, a cam ring for accommodating the rotor therein, the cam ring having a cam face in an inner surface thereof on which a front portion of the vane slides by rotation of the rotor, and a pump chamber defined between the rotor and the cam ring, wherein an eccentric amount of the cam ring to the rotor changes to change a discharge displacement of the pump chamber. The variable displacement vane pump comprises a pump body for accommodating the cam ring therein, a first fluid pressure chamber and a second fluid pressure chamber which are defined in an accommodating space in the outer periphery of the cam ring, wherein the cam ring is made eccentric to the rotor by a pressure difference between the first fluid pressure chamber and the second fluid pressure chamber, a control valve which operates in response to a pump discharge pressure for controlling a pressure of an operating fluid in each of the first fluid pressure chamber and the second fluid pressure chamber in such a manner that an eccentric amount of the cam ring to the rotor is reduced to be small with an increase in a rotation speed of the rotor, a pressure applying section for applying a pressure to the cam ring in a direction of increasing the eccentric amount of the cam ring to the rotor by introducing the operating fluid discharged from the pump chamber into the second fluid pressure chamber all the time, and a cam ring movement restricting portion formed in the second fluid pressure chamber for defining a minimum eccentric amount of the cam ring by restricting the movement of the cam ring in a direction of decreasing the eccentric amount of the cam ring to the rotor.

PREFERRED EMBODIMENTS OF THE INVENTION

Figure 1:
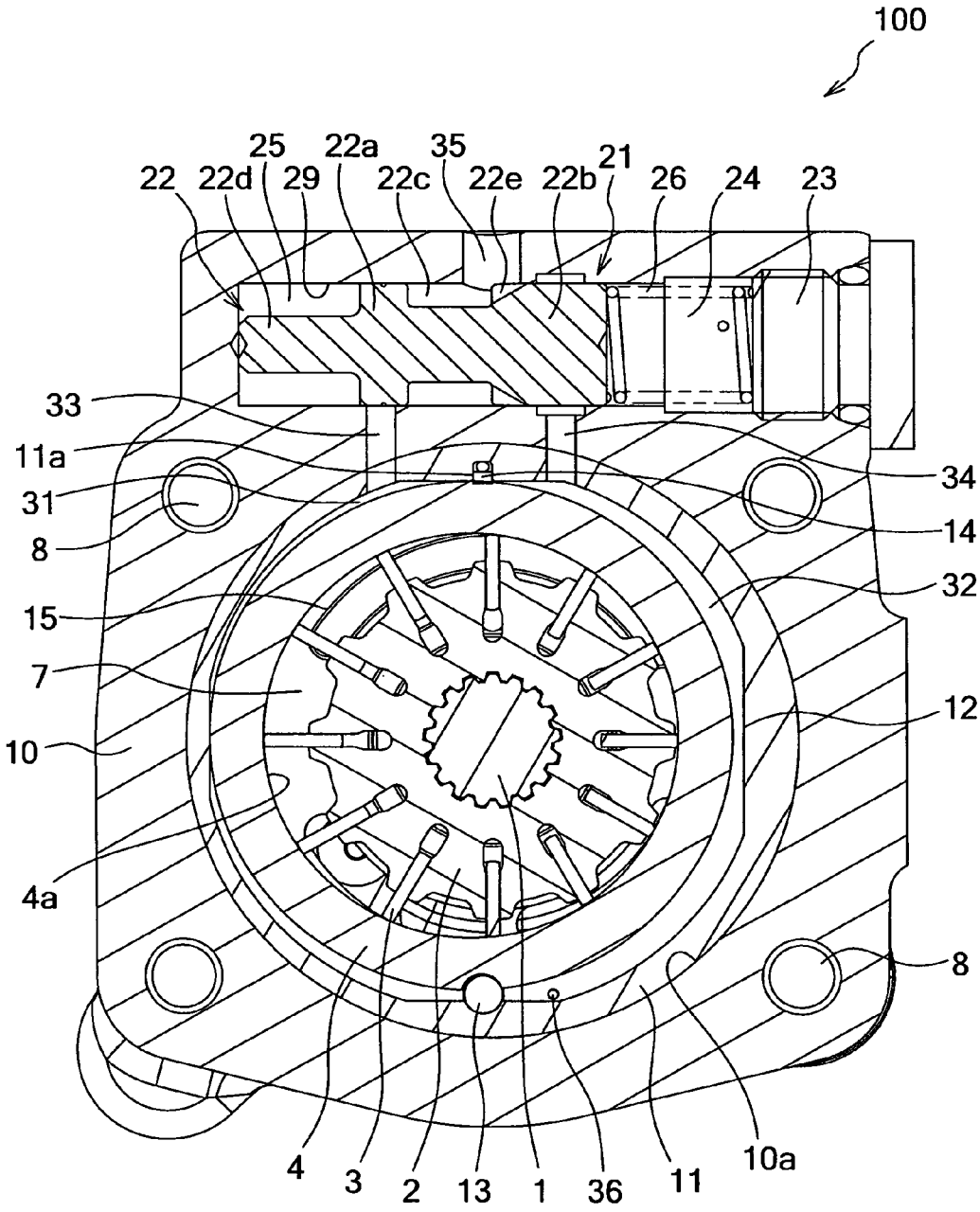
FIG. 1 is a cross-sectional view showing a cross section perpendicular to a dive shaft in a variable displacement vane pump according to an embodiment in the present invention and a state where the pump discharge displacement is maximized.

Hereinafter, an embodiment in the present invention will be explained with reference to the accompanying drawings.

A variable displacement vane pump 100 according to an embodiment in the present invention will be explained with reference to FIGS. 1 to 4. The variable displacement vane pump 100 (hereinafter, referred to as "vane pump" simply) is used as a hydraulic supply source for hydraulic equipment mounted in a vehicle. The hydraulic equipment is, for example, a power steering apparatus or a transmission.

In the vane pump 100, power of an engine (not shown) is transmitted to a drive shaft 1 and thereby a rotor 2 connected to the drive shaft 1 rotates. The rotor 2 rotates in a counterclockwise direction in FIGS. 1 and 2.

The vane pump 100 is provided with a plurality of vanes 3 provided in the rotor 2 so as to be capable of reciprocating in the diameter direction of the rotor 2, and a cam ring 4 which accommodates the rotor 2 therein where a front portion of the vane 3 is in sliding contact with a cam face 4a constituting an inner periphery of the cam ring 4 by rotation of the rotor 2.

The drive shaft 1 is supported through a bush 27 (refer to FIG. 3) to a pump body 10 so as to rotate freely thereto. The pump body 10 is provided with a pump accommodating concave portion 10*a* formed therein for accommodating the cam ring 4. A seal 20 is provided in an end of the pump body 10 for preventing a leak of lubricant between an outer periphery of the drive shaft 1 and an inner periphery of the bush 27.

A side plate 6 is arranged in a bottom surface 10*b* of the pump accommodating concave portion 10*a* and abuts on one end portion of each of the rotor 2 and the cam ring 4. An opening of the pump accommodating concave portion 10*a* is closed by a pump cover 5 abutting on the other end portion of each of the rotor 2 and the cam ring 4. The pump cover 5 is provided with a circular fitting portion 5*a* formed therein for being fitted into the pump accommodating concave portion 10*a* where an end surface of the fitting portion 5*a* abuts on the other end portion of each of the rotor 2 and the cam ring 4. The pump cover 5 is fastened to a ring-shaped skirt portion 10*c* of the pump body 10 by bolts 8.

In this way, the pump cover 5 and the side plate 6 are arranged in such a manner as to sandwich both side surfaces of each of the rotor 2 and the cam ring 4. In consequence, pump chambers 7 are defined to be partitioned by the respective vanes 3 between the rotor 2 and the cam ring 4.

Figure 2:
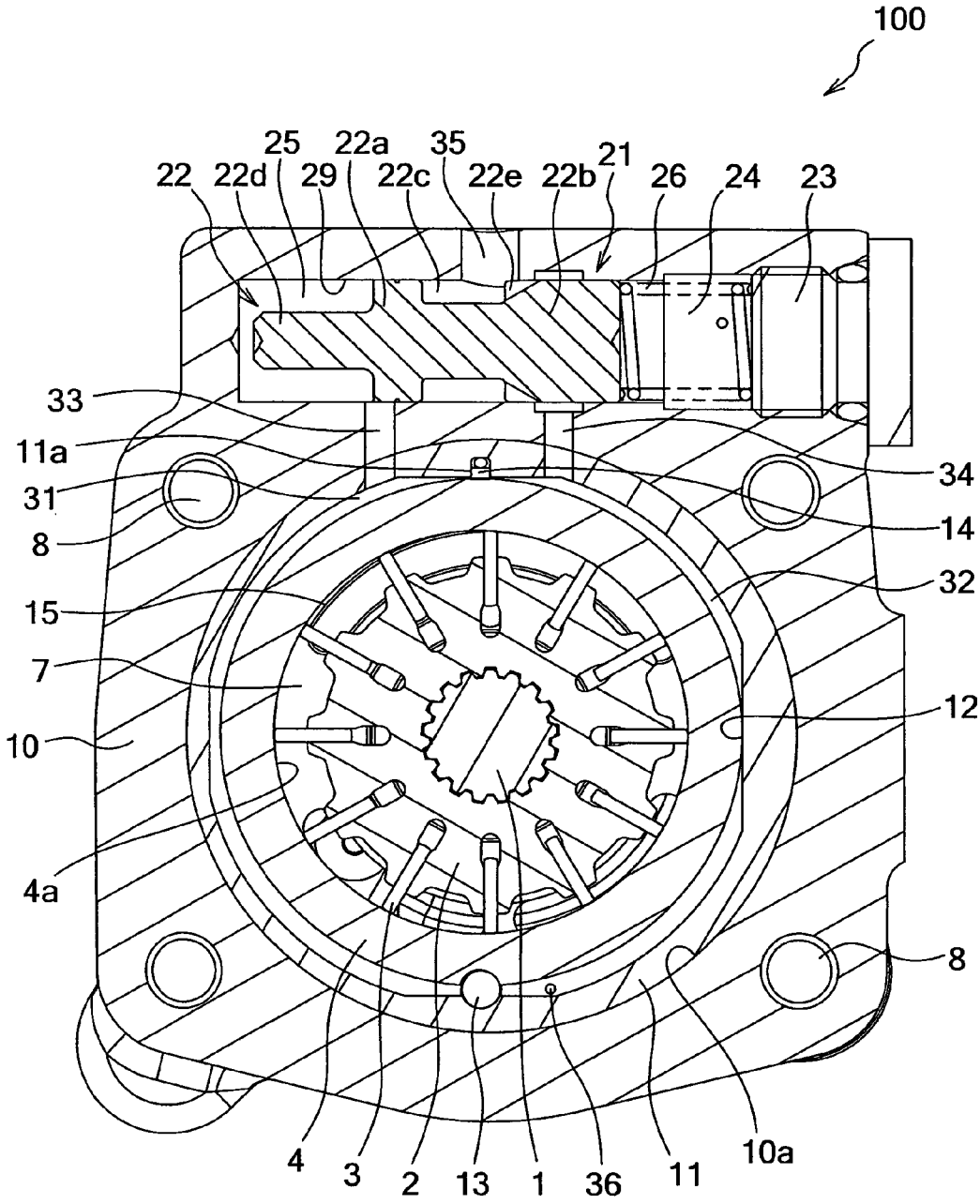
FIG. 2 is a cross-sectional view showing a cross section perpendicular to the dive shaft in the variable displacement vane pump according to the embodiment in the present invention and a state where the pump discharge displacement is minimized.
Figure 3:
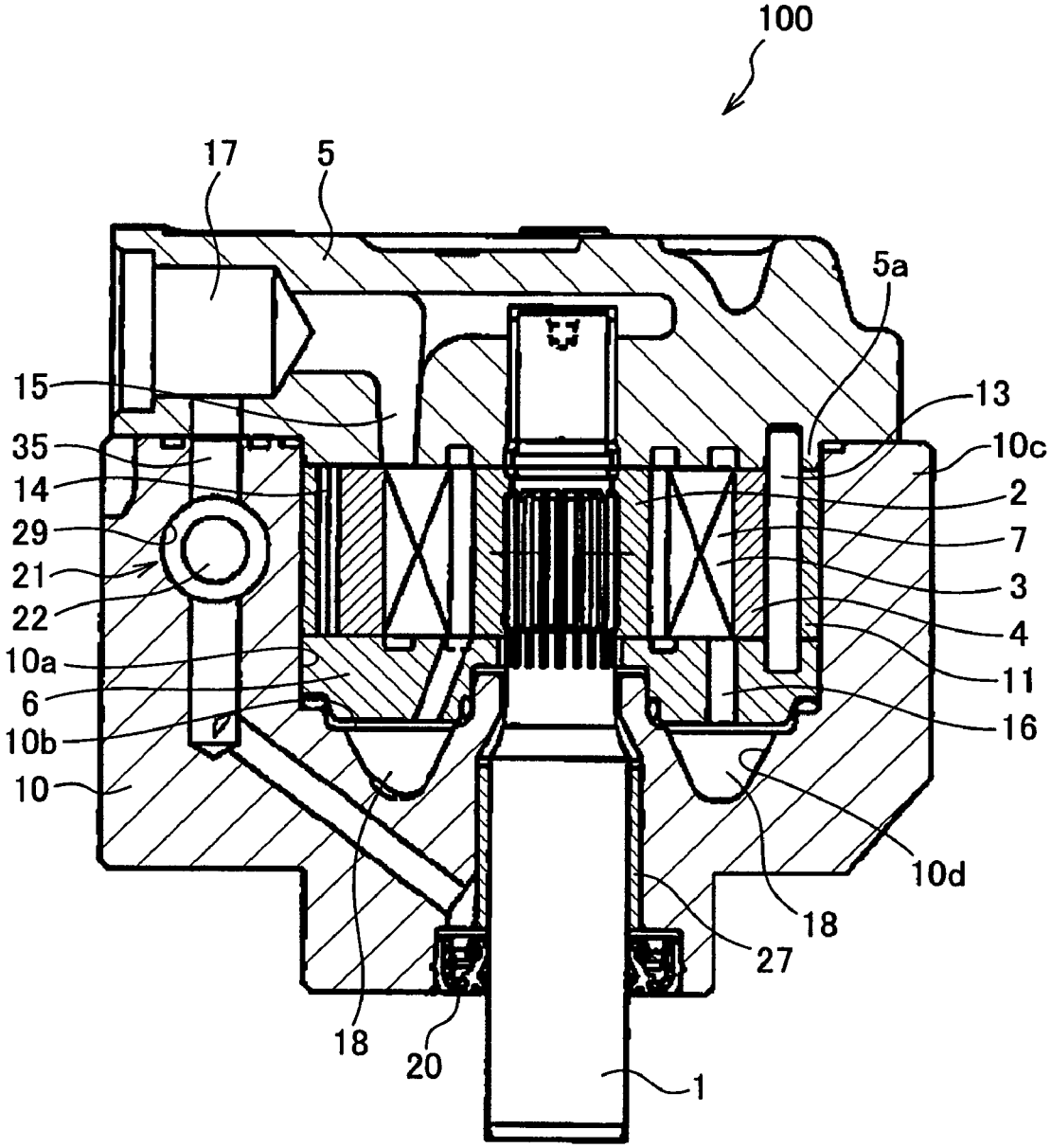
FIG. 3 is a cross-sectional view showing a cross section in parallel with the dive shaft in the variable displacement vane pump according to the embodiment in the present invention.
Figure 4:
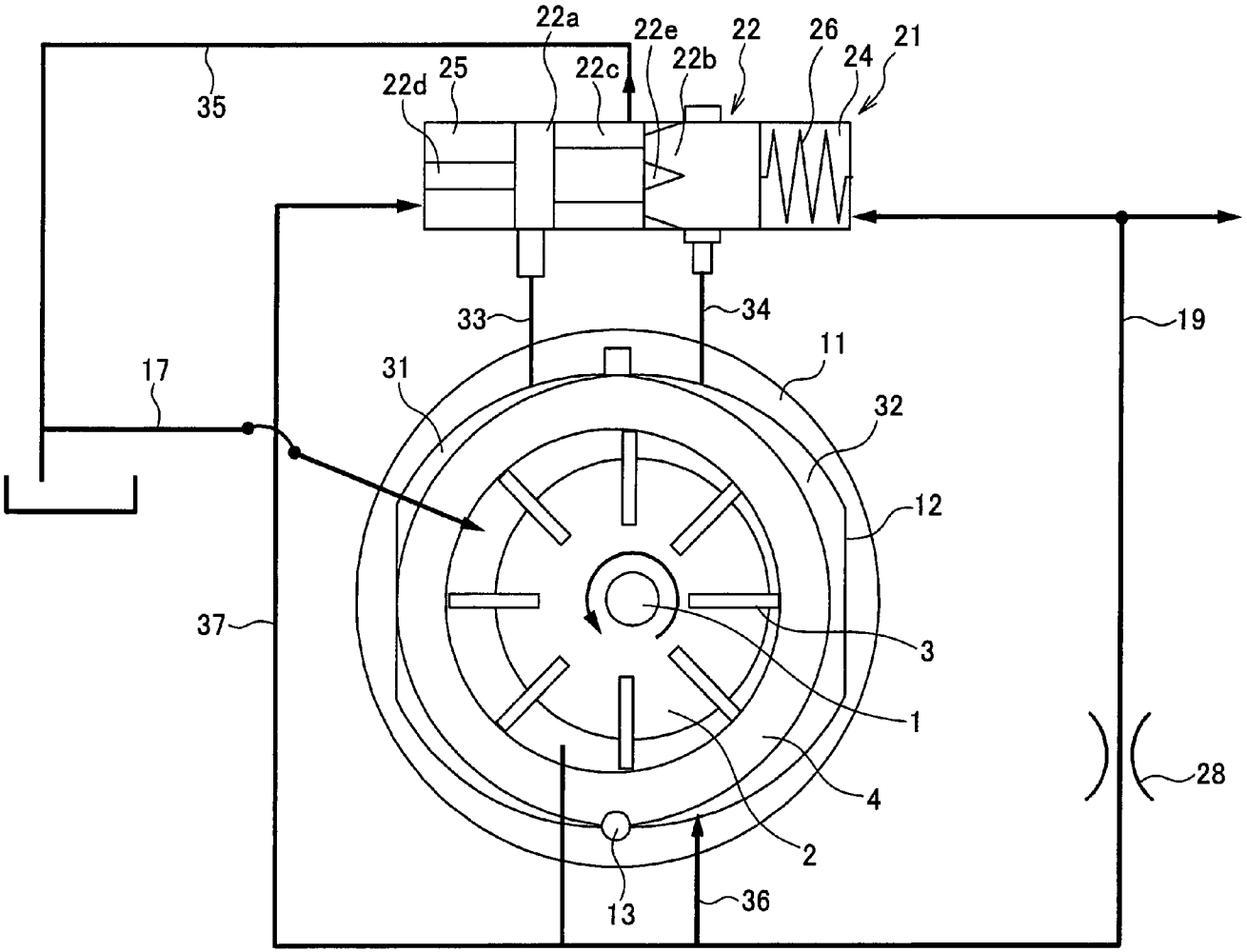
FIG. 4 is a hydraulic circuit diagram in the variable displacement vane pump according to the embodiment in the present invention.

The cam ring 4 is a ring-shaped member and has a suction region for expanding a displacement of the pump chamber 7 partitioned by and between the respective vanes 3 by rotation of the rotor 2 and a discharge region for contracting the displacement of the pump chamber 7 partitioned by and between the respective vanes 3 by rotation of the rotor 2. The pump chamber 7 suctions an operating oil (operating fluid) in the suction region and discharges the operating oil in the discharge region. In FIGS. 1 and 2, a part above a horizontal line passing through a center of the cam ring 4 shows the suction region and a part under the horizontal line shows the discharge region.

A ring-shaped adapter ring 11 is fitted onto an inner peripheral surface of the pump accommodating concave portion 10*a* in such a manner as to surround the cam ring 4. The adapter ring 11 has both side surfaces sandwiched by the pump cover 5 and the side plate 6 in the same way as the rotor 2 and the cam ring 4.

A support pin 13 is supported on an inner peripheral surface of the adapter ring 11 and extends in parallel with the drive shaft 1, and both ends of the support pin 13 each are inserted into the pump cover 5 and the side plate 6. The cam ring 4 is supported by the support pin 13, and the cam ring 4 swings around the support pin 13 as a supporting point inside the adapter ring 11.

Since the support pin 13 has both ends each inserted into the pump cover 5 and the side plate 6 and supports the cam ring 4, the support pin 13 restricts a relative rotation of the pump cover 5 and the side plate 6 to the cam ring 4.

A groove 11*a* extending in parallel with the drive shaft 1 is formed in the inner peripheral surface of the adapter ring 11 at a position axisymmetric to the support pin 13. A seal member 14 is attached in the groove 11*a* to be in sliding contact with an outer peripheral surface of the cam ring 4 at the swinging of the cam ring 4.

A first fluid pressure chamber 31 and a second fluid pressure chamber 32 are defined in a space between the outer peripheral surface of the cam ring 4 and the inner peripheral surface of the adapter ring 11 by the support pin 13 and the seal member 14, which is an accommodating space in the outer periphery of the cam ring 4.

The cam ring 4 swings around the support pin 13 as a supporting point caused by a pressure difference in operation oil between the first fluid pressure chamber 31 and the second fluid pressure chamber 32. When the cam ring 4 swings around the support pin 13 as the supporting point, an eccentric amount of the cam ring 4 to the rotor 2 changes to change a discharge displacement of the pump chamber 7. In a case where a pressure in the first fluid pressure chamber 31 is larger than a pressure in the second fluid pressure chamber 32, the eccentric amount of the cam ring 4 to the rotor 2 is reduced, so that the discharge displacement of the pump chamber 7 becomes small. In contrast, in a case where the pressure in the second fluid pressure chamber 32 is larger than the pressure in the first fluid pressure chamber 31, the eccentric amount of the cam ring 4 to the rotor 2 is increased, so that the discharge displacement of the pump chamber 7 becomes large. In this way, in the vane pump 100, the eccentric amount of the cam ring 4 to the rotor 2 changes caused by the pressure difference between the first fluid pressure chamber 31 and the second fluid pressure chamber 32 to change the discharge displacement of the pump chamber 7.

A swelling portion 12 is formed on the inner peripheral surface of the adapter ring 11 in the second fluid pressure chamber 32 to serve as a cam ring movement restricting portion for restricting the movement of the cam ring 4 in a direction of decreasing the eccentric amount of the cam ring 4 to the rotor 2. The swelling portion 12 defines the minimum eccentric amount of the cam ring 4 to the rotor 2 and maintains a state where an axis center of the rotor 2 is shifted from an axis center of the cam ring 4 in a state where the outer peripheral surface of the cam ring 4 abuts on the swelling portion 12.

The swelling portion 12 is formed so that the eccentric amount of the cam ring 4 to the rotor 2 does not become a zero. That is, the swelling portion 12 is configured so that even in a state where the outer peripheral surface of the cam ring 4 abuts on the swelling portion 12, the minimum eccentric amount of the cam ring 4 to the rotor 2 is ensured, causing the pump chamber 7 to discharge the operating oil. In this way, the swelling portion 12 secures the minimum discharge displacement of the pump chamber 7.

It should be noted that the swelling portion 12 may be formed on the outer peripheral surface of the cam ring 4 in the second fluid pressure chamber 32 instead of being formed on the inner peripheral surface of the adapter ring 11. In addition, in a case where the first fluid pressure chamber 31 and the second fluid pressure chamber 32 are defined between the outer peripheral surface of the cam ring 4 and the inner peripheral surface of the pump accommodating concave portion 10*a* without providing the adapter ring 11, the swelling portion 12 may be formed on the inner peripheral surface of the pump accommodating concave portion 10*a*.

The pump cover 5 is provided with a suction port 15 (refer to FIG. 3) formed therein as opened in an arc shape corresponding to the suction region of the pump chamber 7. In addition, the side plate 6 is provided with a discharge port 16 formed therein as opened in an arc shape corresponding to the discharge region of the pump chamber 7. Each of the suction port 15 and the discharge port 16 is preferably formed in an arc shape similar to that of each of the suction region and the discharge region of the pump chamber 7, but may be formed in any shape as long as each of the suction port 15 and the discharge port 16 is positioned so as to be communicated with each of the suction region and the discharge region.

Since the relative rotation of the pump cover 5 and the side plate 6 to the cam ring 4 is restricted by the support pin 13, the position shift of the suction port 15 to the suction region and the position shift of the discharge port 16 to the discharge region are prevented.

The suction port 15 is formed in the pump cover 5 so as to be communicated with a suction passage 17 formed in the pump cover 5 to introduce the operating oil in the suction passage 17 into the suction region of the pump chamber 7.

The discharge port 16 is formed in the side plate 6 so as to be communicated with a high-pressure chamber 18 as a high-pressure portion formed in the pump body 10 to introduce the operating oil discharged from the discharge region of the pump chamber 7 into the high-pressure chamber 18.

The high-pressure chamber 18 is defined by sealing a groove portion 10d formed as opened in a ring-shape to the bottom surface 10*b* in the pump fluid concave portion 10*a* by the side plate 6. The high-pressure chamber 18 is connected to a discharge passage 19 (refer to FIG. 4) formed in the pump body 10 for introducing the operating oil into the hydraulic equipment provided outside of the vane pump 100.

The high-pressure chamber 18 is communicated through a narrow passage 36 (refer to FIGS. 1 and 2) with the second fluid pressure chamber 32 and the operating oil in the high-pressure chamber 18 is regularly introduced into the second fluid pressure chamber 32. That is, the cam ring 4 is all the time subjected to pressures in the direction of increasing the eccentric amount of the cam ring 4 to the rotor 2 from the second fluid pressure chamber 32. This narrow passage 36 corresponds to a pressure applying section for applying pressures to the cam ring 4 in the direction of increasing the eccentric amount of the cam ring 4 to the rotor 2.

In addition, since the high-pressure chamber 18 is formed in the pump body 10, the side plate 6 is pressed toward the side of the rotor 2 and the vane 3 by pressures of the operating oil introduced into the high-pressure chamber 18. In consequence, a clearance of the side plate 6 to the rotor 2 and the vane 3 is reduced to be small, thus prevent the leak of the operating oil. In this way, the high-pressure chamber 18 serves also as a pressure loading mechanism for preventing the leak of the operating oil from the pump chamber 7.

The pump body 10 is provided with a valve accommodating hole 29 formed therein in a direction orthogonal to an axial direction of the drive shaft 1. A control valve 21 is accommodated in the valve accommodating hole 29 for controlling pressures of the operating oil in the first fluid pressure chamber 31 and in the second fluid pressure chamber 32.

The control valve 21 is provided with a spool 22 inserted into the valve accommodating hole 29 in such a manner as to slide therein, a first spool chamber 24 defined between one end of the spool 22 and a plug 23 sealing an opening of the valve accommodating hole 29, a second spool chamber 25 defined between the other end of the spool 22 and a bottom portion of the valve accommodating hole 29 and a return spring 26 accommodated in the first spool chamber 24 for urging the spool 22 in a direction of expanding a displacement in the first spool chamber 24.

The spool 22 is provided with a first land portion 22*a* and a second land portion 22*b* sliding along an inner peripheral surface of the valve accommodating hole 29, a circular groove 22*c* formed between the first land portion 22*a* and the second land portion 22*b* and a stopper portion 22*d* which is connected to the first land portion 22*a* and which abuts on the bottom portion of the valve accommodating hole 29 to restrict the movement of the spool 22 within a predetermined value when the spool 22 moves in a direction of contracting a displacement in the second spool chamber 25.

The control valve 21 is connected to a first fluid pressure passage 33 communicated with the first fluid pressure chamber 31 and a second fluid pressure passage 34 communicated with the second fluid pressure chamber 32, a drain passage 35 serving as a low-pressure portion communicated with a circular groove 22*c* and also communicated with the suction passage 17, and a pressure introducing passage 37 (refer to FIG. 4) communicated with the second spool chamber 25 and also communicated with the high-pressure chamber 18.

The first fluid pressure passage 33 and the second fluid pressure passage 34 are formed inside the pump body 10 and also formed so as to penetrate through the adapter ring 11.

The spool 22 stops in a position where a load by the pressures of the operating oil introduced into the first spool chamber 24 and the second spool chamber 25 defined in both ends of the spool 22 balances with an urging force of the return spring 26. Depending on the position of the spool 22, the first fluid pressure passage 33 is opened/closed by the first land portion 22*a* and the second fluid pressure passage 34 are opened/closed by the second land portion 22*b*, thereby supplying/discharging the operating oil in each of the first fluid pressure chamber 31 and the second fluid pressure chamber 32.

In a case where a total load of the load by the pressure in the first spool chamber 24 and the urging force of the return spring 26 is larger than the load by the pressure in the second spool chamber 25, the return spring 26 extends to position the spool 22 in a state where the stopper portion 22*d* abuts on the bottom portion of the valve accommodating hole 29. In this state, as shown in FIG. 1, the first fluid pressure passage 33 is blocked up by the first land portion 22*a* of the spool 22 and the second fluid pressure passage 34 is blocked up by the second land portion 22*b* of the spool 22. In consequence, communication between the first fluid pressure chamber 31 and the high-pressure chamber 18 is blocked and also communication between the second fluid pressure chamber 32 and the drain passage 35 is blocked. Here, since the operating oil in the high-pressure chamber 18 is all the time introduced through the narrow passage 36 into the second fluid pressure chamber 32, a pressure in the second fluid pressure chamber 32 is larger than a pressure in the first fluid pressure chamber 31 and the eccentric amount of the cam ring 4 to the rotor 2 is maximized.

In contrast, In a case where the total load of the load by the pressure in the first spool chamber 24 and the urging force of the return spring 26 is smaller than the load by the pressure in the second spool chamber 25, the return spring 26 is compressed and the spool 22 moves against the urging force of the return spring 26. In this case, as shown in FIG. 2, the first fluid pressure passage 33 is communicated with the second spool chamber 25 and is communicated through the second spool chamber 25 with the pressure introducing passage 37. In addition, the second fluid pressure passage 34 is communicated with the circular groove 22*c* of the spool 22 and is communicated through the circular groove 22*c* with the drain passage 35. Thereby, the first fluid pressure chamber 31 is communicated with the high-pressure chamber 18 and the second fluid pressure chamber 32 is communicated with the drain passage 35. Accordingly, the pressure in the second fluid pressure chamber 32 is smaller than the pressure in the first fluid pressure chamber 31 and the cam ring 4 moves in a direction of decreasing the eccentric amount to the rotor 2.

It should be noted that the communication between the second fluid pressure passage 34 and the circular groove 22*c* is made by a notch 22*e* formed in the second land portion 22*b* of the spool 22. As a result, an open area of the drain passage 35 to the second fluid pressure chamber 32 increases/decreases in response to the movement amount of the spool 22.

The control valve 21, as described above, controls the pressure of the operating oil in each of the first fluid pressure chamber 31 and the second fluid pressure chamber 32 and operates with a pressure difference between before and after an orifice 28 (refer to FIG. 4) interposed in the discharge passage 19. The operating oil downstream of the orifice 28 is introduced into the first spool chamber 24 and the operating oil upstream of the orifice 28 is introduced into the second spool chamber 25.

That is, the operating oil in the high-pressure chamber 18 is introduced through the orifice 28 into the first spool chamber 24 and is also introduced through the pressure introducing passage 37 into the second spool chamber 25 without via the orifice 28. It should be noted that the orifice 28 interposed in the discharge passage 19 may be constructed of either a variable type or a stationary type as long as the orifice 28 applies resistance to the flow of the operating oil discharged from the pump chamber 7.

Next, an operation of the vane pump 100 constructed as described above will be explained.

When power of the engine is transmitted to the drive shaft 1 to rotate the rotor 2, the pump chamber 7 expanded by and between the respective vanes 3 caused by rotation of the rotor 2 suctions the operating oil through the suction port 15 from the suction passage 17. In addition, the pump chamber 7 contracted by and between the respective vanes 3 discharges the operating oil through the discharge port 16 into the high-pressure chamber 18. The operating oil discharged into the high-pressure chamber 18 is supplied through the discharge passage 19 into the hydraulic equipment.

When the operating oil passes through the discharge passage 19, a pressure difference occurs between before and after the orifice 28 interposed in the discharge passage 19, and the pressure downstream of the orifice 28 is introduced into the first spool chamber 24 and the pressure upstream of the orifice 28 is introduced into the second spool chamber 25. The spool 22 in the control valve 21 moves to a position where a load caused by a pressure difference between the operation oil introduced into the first spool chamber 24 and the operation oil introduced into the second spool chamber 25 balances with an urging force of the return spring 26.

Since a rotation speed of the rotor 2 is small at a pump starting time, the pressure difference between before and after the orifice 28 in the discharge passage 19 is small. Therefore, the spool 22 is, as shown in FIG. 1, is at a position where the stopper portion 22*d* forcibly abuts on the bottom portion of the valve accommodating hole 29 by the urging force of the return spring 26. In this case, by the spool 22, the communication between the first fluid pressure chamber 31 and the high-pressure chamber 18 is blocked and also the communication between the second fluid pressure chamber 32 and the drain passage 35 is blocked. Here, since the cam ring 4 is subjected to the pressure in the direction of increasing the eccentric amount of the cam ring 4 to the rotor 2 by the operating oil in the high-pressure chamber 18 all the time introduced into the second fluid pressure chamber 32, the cam ring 4 is positioned where the eccentric amount to the rotor 2 is maximized.

In this way, the vane pump 100 discharges the operating oil at the maximum discharge displacement and discharges a flow amount substantially in proportion to the rotation speed of the rotor 2. Thereby, even in a case where the rotation speed of the rotor 2 is small, a sufficient flow amount of the operation oil can be supplied to the hydraulic equipment.

On the other hand, when the rotation speed of the rotor 2 increases, the pressure difference between before and after the orifice 28 in the discharge passage 19 becomes large. Therefore, the spool 22 moves against the urging force of the return spring 26. In this case, as shown in FIG. 2, the first fluid pressure chamber 31 is communicated through the second spool chamber 25 with the high-pressure chamber 18 and also the second fluid pressure chamber 32 is communicated through the circular groove 22*c* with the drain passage 35. Therefore, the cam ring 4 moves in the direction of decreasing the eccentric amount of the cam ring 4 to the rotor 2 in response to the pressure difference between the first fluid pressure chamber 31 and the second fluid pressure chamber 32.

When the eccentric amount of the cam ring 4 to the rotor 2 becomes smaller, the outer peripheral surface of the cam ring 4 abuts on the swelling portion 12 in the inner peripheral surface of the adapter ring 11 to restrict the movement of the cam ring 4 (state shown in FIG. 2). In consequence, the eccentric amount of the cam ring 4 to the rotor 2 is minimized and therefore the pump chamber 7 is to discharge the operating oil at the minimum discharge displacement.

In this way, the vane pump 100 is controlled to the pump discharge displacement in accordance with the pressure difference between before and after of the orifice 28 in the discharge passage 19 and the discharge displacement thereof gradually reduces in response to an increase of the rotation speed of the rotor 2. In addition, in a case where the eccentric amount of the cam ring 4 to the rotor 2 is minimized, the vane pump 100 discharges the operating oil at the minimum discharge displacement. Thereby, the operating oil supplied to the hydraulic equipment at a vehicle running time is appropriately controlled.

In addition, in a state where the rotor 2 is stopped, that is, the vane pump 100 is stopped, the cam ring 4 stops at a position where the pressure in the first fluid pressure chamber 31 balances with the pressure in the second fluid pressure chamber 32. Even in this case, the eccentric amount of the cam ring 4 to the rotor 2 does not become a zero or less because of the swelling portion 12 defining the minimum eccentric amount. Therefore, also at a starting time of the vane pump 100 when the power of the engine is transmitted to the drive shaft 1 to start the rotation of the rotor 2, the vane pump 100 stably starts discharge of the operating oil.

As described above, at the pump starting time the vane pump 100 discharges the operating oil at the maximum discharge displacement by the operating oil in the high-pressure chamber 18 all the time introduced into the second fluid pressure chamber 32. Even in a case where the discharge displacement thereof gradually reduces with an increase of the rotation speed of the rotor 2 and the eccentric amount of the cam ring 4 to the rotor 2 reaches to the minimum value, the vane pump 100 discharges the operating oil at the minimum discharge displacement because of the swelling portion 12.

According to the above embodiment, the effect shown below can be achieved.

Since the cam ring 4 is subjected to the pressure in the direction of increasing the eccentric amount of the cam ring 4 to the rotor 2 by the operating oil which is discharged from the pump chamber 7 and is all the time introduced into the second fluid pressure chamber 32, in a case where the rotation speed of the rotor 2 is small, the eccentric amount of the cam ring 4 to the rotor 2 is maximized. In addition, in a case where the eccentric amount of the cam ring 4 to the rotor 2 becomes small with an increase of the rotation speed of the rotor 2, the movement of the cam ring 4 is restricted by the swelling portion 12 defining the minimum eccentric amount.

In the conventional vane pump, the cam ring is urged in the direction of maximizing the pump discharge displacement by the spring. This spring serves so as to prevent the eccentric amount of the cam ring to the rotor from being a zero.

On the other hand, the vane pump 100 according to the present embodiment, at the pump starting time discharges the operating oil at the maximum discharge displacement by the operating oil in the high-pressure chamber 18 all the time introduced into the second fluid pressure chamber 32. Even in a case where the discharge displacement thereof gradually reduces with an increase of the rotation speed of the rotor 2 and the eccentric amount of the cam ring 4 to the rotor 2 reaches to the minimum value, the vane pump 100 discharges the operating oil at the minimum discharge displacement. Therefore, the spring in the conventional vane pump becomes unnecessary.

Accordingly, the spring provided in the conventional vane pump becomes unnecessary and it is not required also to provide the through bore for incorporating the spring into the pump body 10 and the adapter ring 11. Therefore, the structure of the vane pump is simplified. In addition, the process of incorporating the respective members such as the spring into the pump body 10 and the adapter ring 11 is not necessary. Accordingly, the manufacturing cost of the vane pump 100 can be reduced.

While only the selected preferred embodiment has been chosen to illustrate the present invention, it will be apparent to those skilled in the art from this disclosure that various changes and modifications can be made therein without departing from the scope of the invention as defined in the appended claims. Furthermore, the foregoing description of the preferred embodiment according to the present invention is provided for illustration only, and not for the purpose of limiting the invention as defined by the appended claims and their equivalents.

What is claimed is:

1. A variable displacement vane pump having a rotor connected to a drive shaft, a plurality of vanes provided in the rotor so as to be capable of reciprocating in a diameter direction of the rotor, a cam ring for accommodating the rotor therein, the cam ring having a cam face in an inner surface thereof on which a front portion of each of the vanes slides by rotation of the rotor, and a pump chamber defined between the rotor and the cam ring, wherein an eccentric amount of the cam ring to the rotor changes to change a discharge displacement of the pump chamber, the variable displacement vane pump comprising:

a pump body configured to accommodate the cam ring therein;

a first fluid pressure chamber and a second fluid pressure chamber, wherein the cam ring is made eccentric to the rotor only by a pressure difference between the first fluid pressure chamber and the second fluid pressure chamber;

an adapter ring configured to define the first fluid pressure chamber and the second fluid pressure chamber between the adapter ring and an outer peripheral surface of the cam ring;

a control valve which operates in response to a pump discharge pressure for controlling a pressure of an operating fluid in each of the first fluid pressure chamber and the second fluid pressure chamber in such a manner that an eccentric amount of the cam ring to the rotor becomes small with an increase in a rotation speed of the rotor;

a pressure applying section configured to apply a pressure to the cam ring in a direction of increasing the eccentric amount of the cam ring to the rotor by continuously introducing the operating fluid discharged from the pump chamber into the second fluid pressure chamber; and a cam ring movement restricting portion formed in the second fluid pressure chamber and configured to define a minimum eccentric amount of the cam ring by restricting the movement of the cam ring in a direction of decreasing the eccentric amount of the cam ring to the rotor;

wherein the cam ring movement restricting portion includes a swelling portion formed on an inner peripheral surface of the adapter ring or on the outer peripheral surface of the cam ring.

2. The variable displacement vane pump according to claim 1, further comprising:

an orifice configured to apply resistance to a flow of the operating fluid discharged from the pump chamber, wherein:

the control valve operates in response to a pressure difference between before and after the orifice, at a pump starting time, operates to block communication between the first fluid pressure chamber and a high-pressure portion and also block communication between the second fluid pressure chamber and a low-pressure portion, and operates to communicate the first fluid pressure chamber with the high-pressure portion and also communicate the second fluid pressure chamber with the low-pressure portion, caused by an increase in the rotation speed of the rotor.

3. The variable displacement vane pump according to claim 1, wherein in a state where the cam ring abuts on the cam ring movement restricting portion, an axis center of the rotor is shifted from an axis center of the cam ring.

* * * * *